US011578555B2

(12) United States Patent
Saraya et al.

(10) Patent No.: US 11,578,555 B2
(45) Date of Patent: Feb. 14, 2023

(54) METHODS AND SYSTEMS FOR A FRAC PLUG

(71) Applicant: Vertice Oil Tools, Missouri City, TX (US)

(72) Inventors: Mohamed Ibrahim Saraya, Sugar Land, TX (US); Mike Lo, Houston, TX (US)

(73) Assignee: Vertice Oil Tools Inc., Stafford, TX (US)

( * ) Notice: Subject to any disclaimer, the term of this patent is extended or adjusted under 35 U.S.C. 154(b) by 0 days.

(21) Appl. No.: 16/851,563

(22) Filed: Apr. 17, 2020

(65) Prior Publication Data

US 2021/0032956 A1 Feb. 4, 2021

Related U.S. Application Data

(63) Continuation-in-part of application No. 16/528,831, filed on Aug. 1, 2019, now Pat. No. 11,085,267.

(51) Int. Cl.
*E21B 33/129* (2006.01)
*E21B 33/128* (2006.01)
*E21B 33/12* (2006.01)

(52) U.S. Cl.
CPC ..... *E21B 33/1293* (2013.01); *E21B 33/1208* (2013.01); *E21B 33/128* (2013.01)

(58) Field of Classification Search
CPC ... E21B 33/129; E21B 33/128; E21B 33/1208
See application file for complete search history.

(56) References Cited

U.S. PATENT DOCUMENTS 4,813,481 A * 3/1989 Sproul ..... E21B 34/063 166/325
5,058,673 A * 10/1991 Muller ..... E21B 33/1243 166/187
2003/0221837 A1* 12/2003 Giroux ..... E21B 43/10 166/321
2008/0271883 A1* 11/2008 Barton ..... E21B 34/063 166/332.8
2013/0048271 A1* 2/2013 VanLue ..... E21B 33/134 166/118
2014/0251593 A1* 9/2014 Oberg ..... E21B 33/129 166/118
2015/0285026 A1* 10/2015 Frazier ..... E21B 33/134 166/120
2017/0130552 A1* 5/2017 Moyes ..... E21B 33/128
2018/0051532 A1* 2/2018 Smith ..... E21B 43/26
2019/0162044 A1* 5/2019 Dirocco ..... E21B 33/128
2019/0203556 A1* 7/2019 Powers ..... E21B 41/0021
2019/0352998 A1* 11/2019 Wolf ..... E21B 33/128

OTHER PUBLICATIONS

Schlumberger Glossary definition of "rupture disk" available from: https://glossary.slb.com/en/Terms/r/rupture_disk.aspx (Year: 2022).*

* cited by examiner

*Primary Examiner* — Blake Michener
*Assistant Examiner* — Theodore N Yao
(74) *Attorney, Agent, or Firm* — Pierson IP, PLLC

(57) ABSTRACT

An outer diameter of a mandrel with a recess to accommodate lower slips with a larger thickness, a sealing element with a concave outer diameter to control a pressure differential caused by a Bernoulli Effect across the sealing element, and a disc that is selectively secured to a housing via a removable shear pin, wherein shear pins with different pressure ratings may be inserted into the housing.

20 Claims, 5 Drawing Sheets

METHODS AND SYSTEMS FOR A FRAC PLUG

BACKGROUND INFORMATION

Field of the Disclosure

Examples of the present disclosure relate to reducing a thickness of an outer diameter of a mandrel to accommodate lower slips with a larger thickness. Embodiments may also include a packing element/packer with a concave outer diameter to control a pressure differential caused by a Bernoulli Effect to the packing element due to fluid flowing around the packing element. Embodiments may also include a disc that is selectively secured to a housing via a removable shear pin, wherein shear pins with different pressure ratings may be inserted into the housing.

Background

Directional drilling is the practice of drilling non-vertical wells. Horizontal wells tend to be more productive than vertical wells because they allow a single well to reach multiple points of the producing formation across a horizontal axis without the need for additional vertical wells. This makes each individual well more productive by being able to reach reservoirs across the horizontal axis. While horizontal wells are more productive than conventional wells, horizontal wells are costlier.

Conventionally, after cementing a well and to achieve Frac/zonal isolation in a Frac operation, a frac plug and perforations on a wireline are pushed downhole to a desired a depth. Then, a frac plug is set and perforation guns are fired above to create conduit to frac fluid. This enables the fracing fluid to be pumped. Typically, to aid in allowing the assembly of perforation and frac plug to reach the desired depth, specifically in horizontal or deviated laterals, pumping operation can be used. During the pumping operation the wireline is pumped down hole with the aid of flowing fluid.

However, these conventional frac plugs are held in place via slips and packing elements that are limited in thickness based on an outer diameter of the mandrel. This limits the amount of pressure that can be applied to the slips due to material strength, i.e.: the thicker the material the stronger the slips. Furthermore, the packing elements typically have planar or convex outer surfaces with a deflection point on the inner surface. This causes an increase in pressure differential across the deflection point.

Further, conventionally to form a rupture disc that is positioned within a frac plug, a rupture disc with a predetermined pressure rating is positioned within a closed housing. This requires companies to know ahead of time downhole conditions or purchase all potential rupture discs.

Accordingly, needs exist for systems and methods utilizing a frac plug with an outer mandrel with a recess to accommodate thicker lower slips, a packer with a concave outer surface, and discs that are coupled to a housing via interchangeable shear pins.

SUMMARY

Embodiments disclosed herein describe systems and methods for a frac plug with an outer mandrel with a recess to accommodate thicker lower slips, a packer with a concave outer surface, and discs that are coupled to a housing via interchangeable shear pins. The frac plug may be configured to provide zonal isolation in multistage stimulation treatments. The frac plug may be configured to isolate a zone during stimulation but allows flow from below once the stimulation is completed. The frac plug may include a mandrel, slips, a sealing element, and a weak point assembly.

The mandrel of the frac plug may be a cylindrical housing that is configured to support elements of the frac plug. The mandrel may include a variable thickness based on a profile of the inner diameter and outer diameter of the mandrel. The mandrel may include a recess within an indentation. The recess may be a tapered sidewall that gradually decreases a size of the outer diameter of the mandrel from a proximal end of the mandrel to a distal end of the mandrel. The recess may be configured to allow a thickness of the lower slip to be increased.

The slips may include a lower slip and an upper slip. The slips may be configured to radially move across an annulus between the outer diameter of the mandrel and an inner diameter of casing. Responsive to the slips moving across the annulus, the slips may grip the inner diameter of the casing to hold the frac plug in place within the wellbore. The lower slip may be configured to be positioned within the recess before being deployed. Because the lower slip is positioned within the recess, a thickness of portions of the lower slip may be increased in size. The increase in thickness may enable the lower slip to have a higher strength to allow receiving more pressure from above the lower slip while holding the frac plug in place. Additionally, the recess prevents the maximum outer diameter of the Frac Plug maximum to be larger.

The sealing element may be a packing element positioned between the upper slip and the lower slip. The packer may be configured to radially expand to seal across the annulus. An elasticity of the packer may vary based upon its thickness. The packer may include a concave outer surface configured to vary the thickness of the packer at various cross sections. By varying the thickness of the packer, cross-sectional areas of the packer may be varied, which may change a pressure differential across the packer as fluid flows around t. Accordingly, as fluid is pumped within the annulus between the outer surface of the packer and casing, the curvature of the outer surface may control the pressure differential across the packer and within the annulus at different locations, reducing the susceptibility of the element to swab.

The weak point assembly may be configured to be positioned within a flapper or on the mandrel. When the weak point assembly is positioned within a flapper, the weak point assembly may be configured to move when the flapper moves. When the weak point assembly is positioned through the mandrel, the weak point assembly may extend from an inner diameter of the mandrel to an outer diameter of the mandrel. The weak point assembly may include a housing, disc, and shear pin.

The housing may have a passageway extending through the inner diameter of the housing. The passageway may be configured to allow bidirectional flow of fluid through the housing if the rupture disc is not positioned within the housing. The housing may include a disc hole configured to receive the disc, and a shear pin hole configured to receive the shear pin. In embodiments, the disc hole may be positioned on a first end of the housing, and not cover the entirety of the first end of the housing. The shear pin hole may be a hollow passageway that extends across the housing in a direction that is perpendicular to the longitudinal axis of the housing.

The disc may be a solid object or an object configured to break, dissolve, shear, rupture, etc. responsive to a pressure differential across the disc being greater than a rupture threshold, the disc may be made of steel, aluminum, dissolvable or plastic material, or any other material that has strength higher than the shear pins. When the disc is a solid object, the disc may not break of dissolve, and remains intact when moving within the housing. The disc may be configured to be positioned within the disc hole when the shear pin is intact, and move from the first end of the housing and out of the second end of the housing responsive to the shear pin breaking.

The shear pin may be a device that is configured to break responsive to a predetermined pressure or force being applied to the shear pin. Further, the shear pin may be configured to be inserted through the shear pin hole within the housing and the orifice through the rupture disc. As such, the ends of the shear pins may be configured to initially sit on portions of the housing corresponding to the shear pin hole. In embodiments, the shear pin hole may enable different shear pins to be inserted into the housing, wherein the different shear pins may be configured to break at different pressure ratings. Therefore, the shear pin hole may enable the weak point assembly to be customized with different pressure ratings depending on downhole characteristics. Furthermore, the shear pin hole may enable different shear pins to be inserted into the weak point assembly before or after the rupture disc is positioned within the rupture disc hole in the housing.

Responsive to the shear pin being exposed to a pressure above a pressure rating of the shear pin, the shear pin may shear. This may enable to disc to pass through the housing and move downhole.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
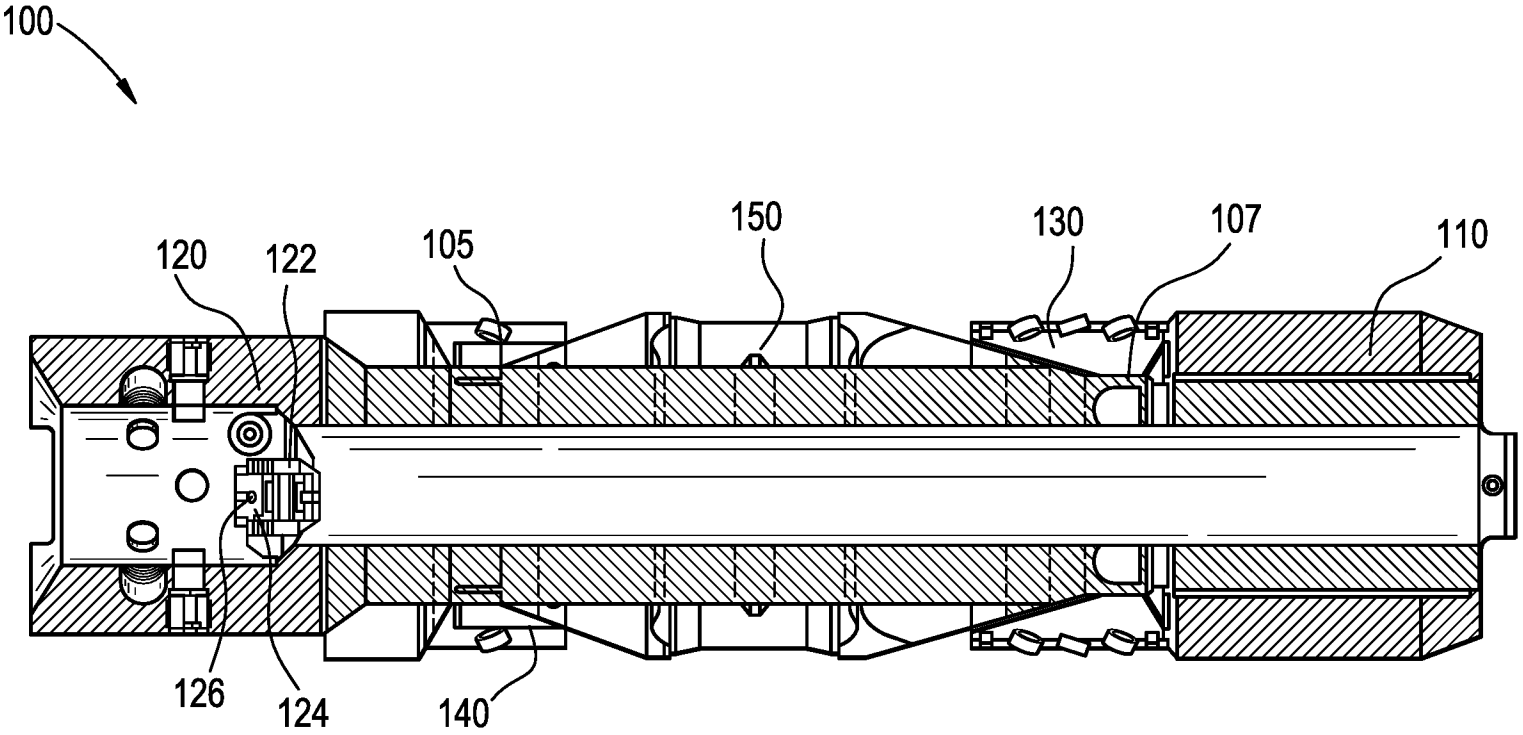
FIG. 1 depicts a frac plug, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a downhole tool 100, according to an embodiment. Downhole tool 100 may include a mandrel 105, pull-down elements 110, weak point assembly 120, lower slips 130, upper slips 140, and sealing element 150.

Pull-down element 110 may be positioned on a distal end of tool 100, while in other embodiments the pull-down element 110 may be positioned on a proximal end of the tool 100, the pull-down element may be configured to assist in pulling down tool 100 through casing. Pull-down tool 110 may multiple pull-down rings, wherein a number of pull-down rings associated with tool 100 may be based on a length of tool 100 and a depth of the casing. The pull-down rings may be projections positioned on an outer diameter of pull-down element 110, and may be configured to increase the outer diameter of pull-down element 110. An outer diameter of the pull-down rings may be greater than that of tool 100 but less than an inner diameter of the casing. As such, the pull-down rings may be configured to receive a force from fluid to pull the pull-down element 110 downhole. Further, each of the pull-down rings may be configured to create friction by interacting with fluid flowing downhole, which may allow pull-down element 110 to be pulled downhole. Each of the pull down rings may have an outer diameter that is sufficiently smaller than that of an inner diameter of the casing, such that the outer diameter of the pull down rings does not directly contact the inner diameter of the casing. This may enable fluid to flow around and within a space between the outer diameter of the pull down rings and the casing.

Weak point assembly 120 may be configured to be positioned within a flapper or within mandrel 105, and weak point assembly 120 may be any geometric shape. The flapper may be configured to have an open and closed positioned responsive to flowing fluid from a distal end of tool 100 towards a proximal end of tool 100 while the weak point assembly 120 is intact. Weak point assembly 120 may include housing 122, disc 124, and shear pin 126.

Housing 122 may be configured to be positioned within a passageway in weak point assembly 120. Housing 122 may be a removable component within weak point assembly or may be an integral component. Housing 122 may have a hollow inner diameter extending from a first face of housing to a second face of housing. In embodiments, fluid may be configured to flow through the hollow inner diameter responsive to disc 124 being removed from housing 122. Housing 122 may be configured to temporarily secure disc 124 and shear pin 126.

Disc 124 may be an object that is configured to be embedded within housing 122 when weak point assembly 120 is intact. Disc 124 may be configured to move downhole etc. responsive to a pressure differential applied to shear pin 126 being greater than a pressure threshold. Disc 124 may be configured to be embedded within a first face of housing 122, such that an outer surface of disc 124 is coplanar with the first face of housing 122.

Shear pin 126 may be a device be inserted into housing 122 and extend through and across disc 124. As such, a length of shear pin 126 may be greater than the diameter of disc 124. Shear pin 126 may be configured to retain disc 124 while shear pin 126 is intact. Shear pin 126 may be exposed to fluid and pressure within a wellbore above housing 122 via disc 124. In embodiments, shear pin 126 may be exposed to shearing forces via pressure applied on the disc, wherein when the shearing forces is greater than a pressure rating of shear pin 126 then shear pin 126 may break. Responsive to breaking shear pin 126, disc 124 may move from a positioned within housing 122 to a position outside of housing 122. In embodiments, shear pin 126 may be configured to be manually removably inserted or removed from housing 122 before or after disc 124 is positioned within housing 122. For example, a first shear pin 126 may be configured to be manually inserted into housing 122, the first shear pin 126 may be removed from housing 122, and a second shear pin may be inserted into housing 122. This may enable shear pins 126 with different pressure ratings to be inserted into housing 122 while the rest of weak point assembly 120 remains intact. Therefore, enabling weak point assembly 120 to not have static predetermined pressure ratings, and allowing weak point assembly 120 to have an exposed passageway at different pressure ratings.

Lower slip 130 and upper slip 140 may be configured to radially move outward across an annulus to secure mandrel 105 to a casing, wherein the annulus is positioned between an outer diameter of mandrel 105 and the casing. Responsive to moving slips 130, 140 across the annulus, slips 130, 140 may grip the inner diameter of the casing.

Figure 2:
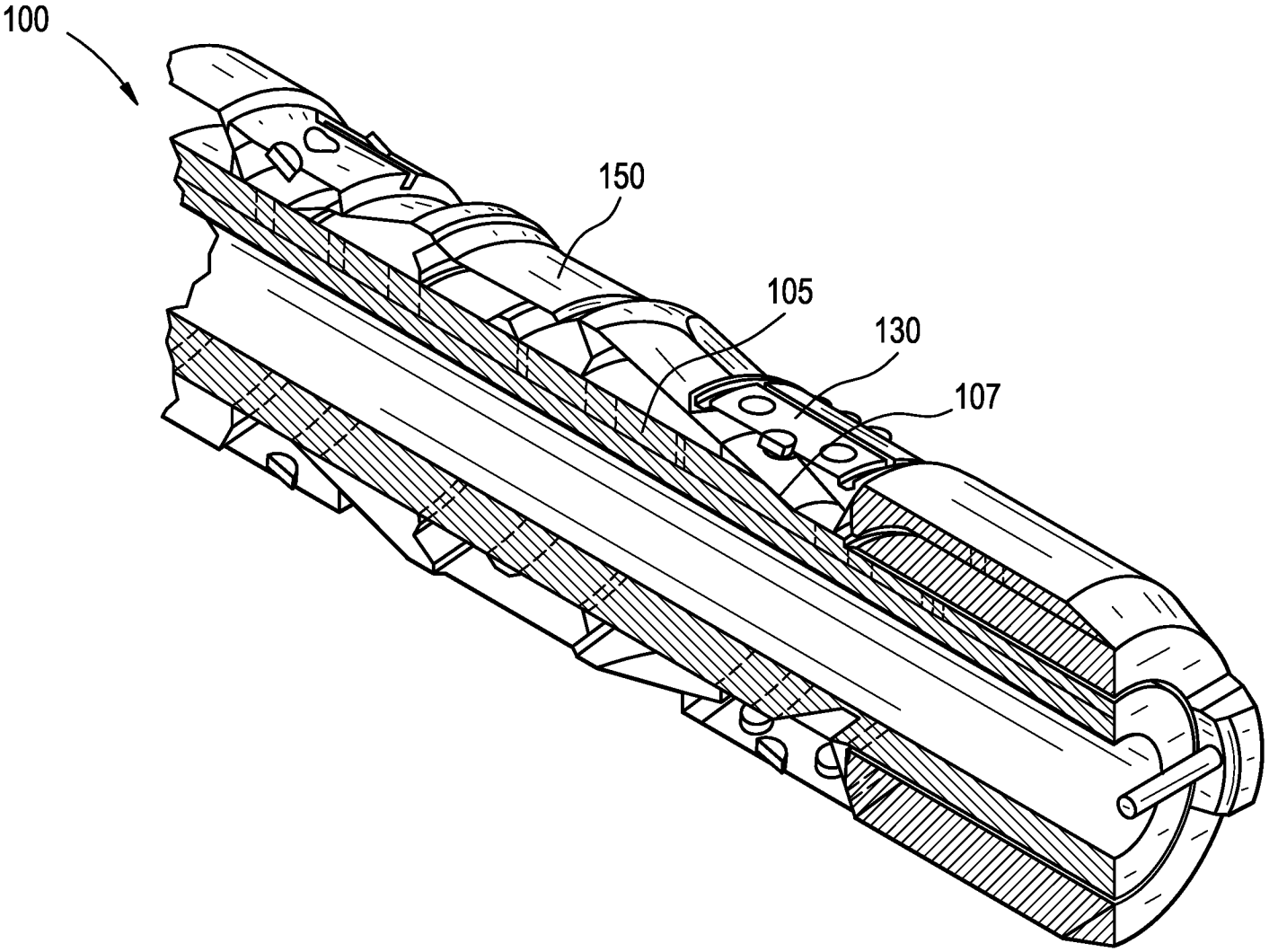
FIG. 2 depicts a frac plug, according to an embodiment.

As depicted in FIG. 2, lower slip 130 may be positioned closer to a distal end of frac plug 100 than upper slip 140, and on a first side of packer 150. Upper slip 140 may be positioned closer to a proximal end of frac plug 100 than lower slip 130, and on a second side of packer 150.

Lower slip 130 may have an inner surface with a first portion positioned adjacent to a cone, and a second portion positioned within a recess 107 within mandrel 105. Recess 107 may have an angled sidewall and a planer sidewall, the angled sidewall may be configured to gradually reduce a thickness of mandrel 105. Lower slip 130 may be configured to be positioned within recess 107 before being deployed. Once deployed, lower slip may move radially away from a central axis of frac plug 100 and no longer be embedded within recess 107. Recess 107 within mandrel 105 may be configured to allow a thickness of lower slip 130 to increase, which may enable lower slip 130 to become stronger so it can receive more force while griping the casing.

Sealing element 150 may be a hydraulic packer that is configured to expand and seal across the annulus based on a pressure differential. An elasticity of sealing element 150 may be based upon the cross sectional thickness of sealing element, which may be controlled based on the profiles of the inner diameter and outer diameter of sealing element 150. Outer diameter of sealing element 150 may have a concave curvature, which increases a thickness of sealing element 150 towards the ends of the longitudinal axis of sealing element 150. By varying the thickness of the sealing element 150, cross-sectional areas of the sealing element 150 may be varied. This may change a pressure differential applied to the sealing element 150 at different cross sectional areas. Accordingly, as fluid is pumped within the annulus between the outer surface of the packer and casing, the curvature of the outer surface may control a Bernoulli Effect and the pressure differential across the sealing element 150 at different locations. As such, sealing element 150 may not deploy prematurely.

Figure 3:
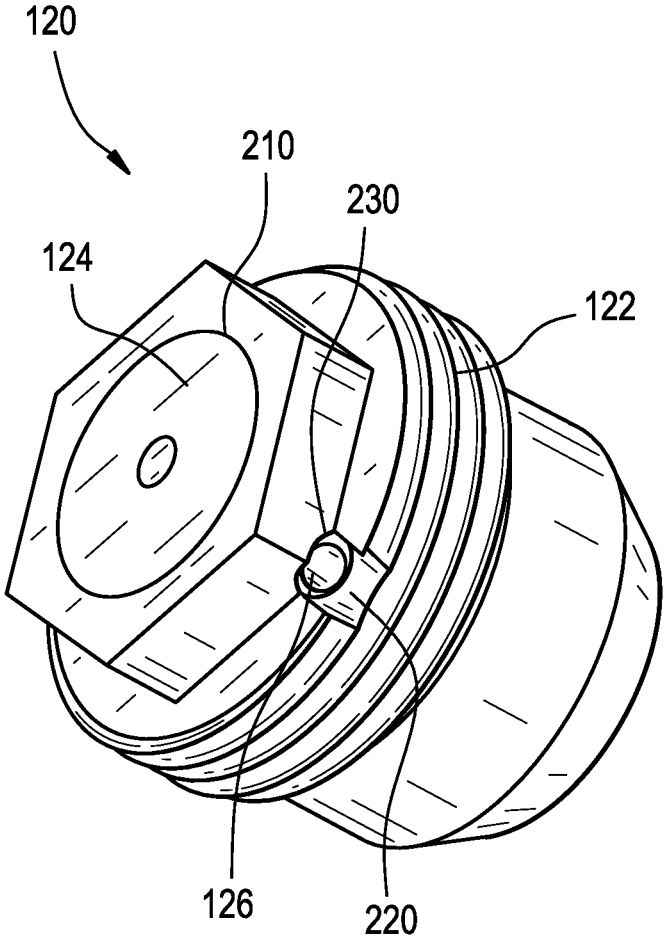
FIG. 3 depicts a weak point assembly, according to an embodiment.
Figure 4:
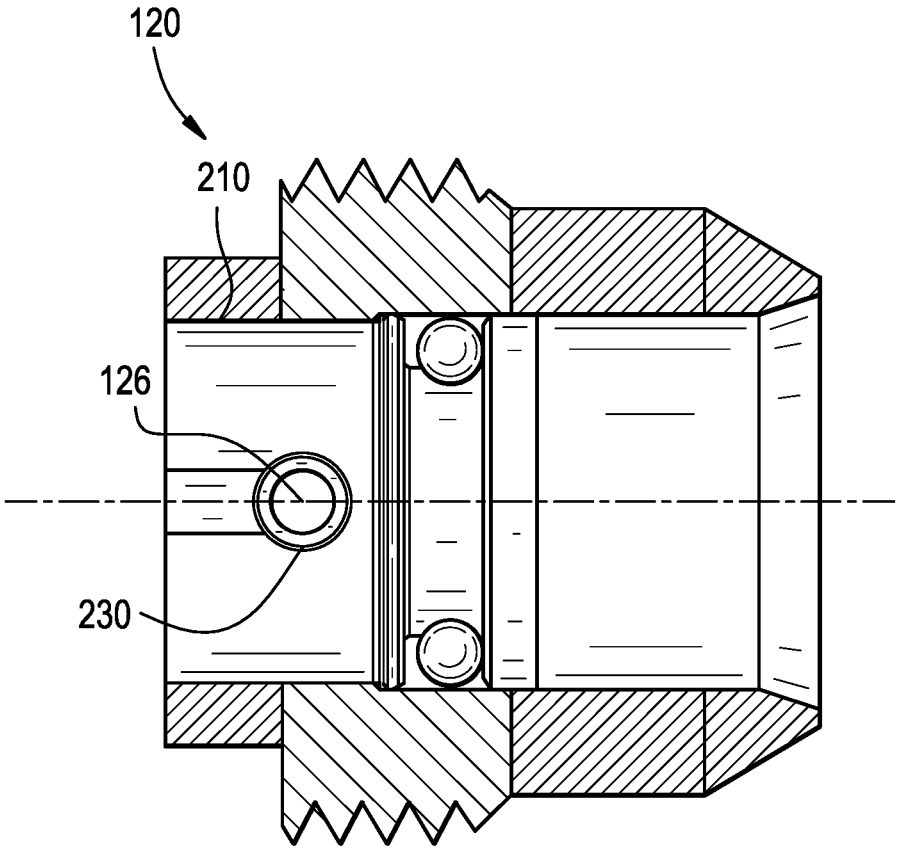
FIG. 4 depicts a weak point assembly, according to an embodiment.

FIGS. 3 and 4 depict a detailed view of weak point assembly 120, according to an embodiment. As depicted in FIGS. 3 and 4, disc 124 may be configured to be positioned within disc hole 210 in housing 122, wherein disc hole 210 is positioned on a first face of housing 122. This may enable the faces of disc 124 and housing 122 to be coplanar.

As further depicted in FIGS. 3 and 4, housing 122 may include ledges 220 and shear pin hole 230. Ledges 220 may be aligned with shear pin hole 230 and be configured to support the ends of shear pin 126 when shear pin 126 is still intact. Shear pin hole 230 may extend across a lateral axis of housing 122, through disc 124, in a direction that is perpendicular to the central axis of housing 122. Shear pin hole 230 may have at least one exposed outer end. This may enable different shear pins, with different pressure ratings, to be manually inserted and removed from shear pin hole 230. Additionally, shear pin hole 230 may enable different shear pins 126 to be inserted into weak point assembly 120 even once disc 124 is embedded within housing 122.

Figure 5:
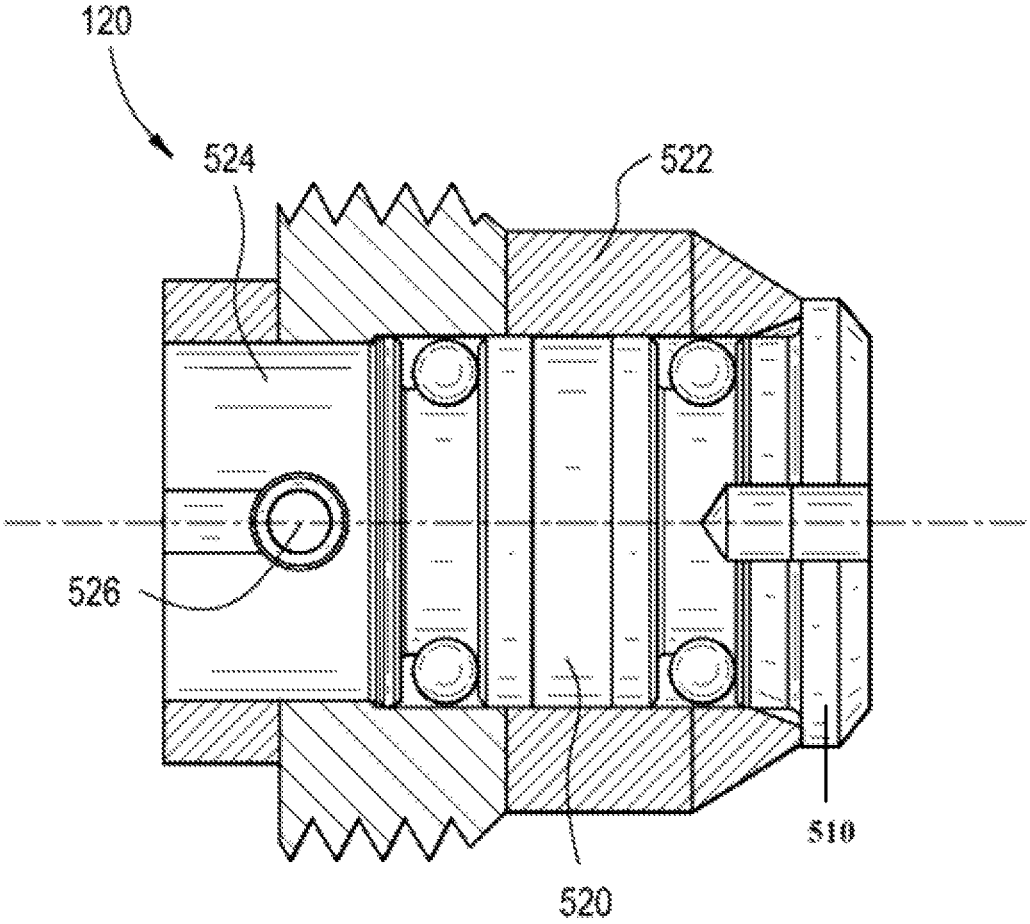
FIG. 5 depicts a weak point assembly, according to an embodiment.

FIG. 5 depicts a weak point assembly 500, according to an embodiment. Elements depicted in FIG. 5 may be described above, and for the sake of brevity a further description of these elements is omitted. Weak point assembly 500 may include housing 522, disc 524, shear pin 526, one way seal 510, and atmospheric chamber 520.

One way seal 510 may be configured to form a seal across an end of weak point assembly 500, and not allow communication between atmospheric chamber 520 and the inner diameter of the casing below weak point assembly 500.

Atmospheric chamber 520 may be a chamber, cavity, compartment, positioned between the one way seal 510 and the distal end of the disc 524. The atmospheric chamber 520 may be configured to have a preset pressure, and may not be in communication with elements outside of the weak point assembly.

In embodiments, because atmospheric chamber 520 has a known preset pressure, the amount of pressure on the shear pin 526 required to break, snap, etc. shear pin 526 is also known based on a pressure threshold associated with the pressure rating of the shear pin 526, the pressure associated with atmospheric chamber 520, and the pressure applied to shear pin 526.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A frac plug comprised of:

a mandrel with a recess, the recess being a first tapered sidewall that continually decreases a first thickness of the mandrel from a proximal end of the mandrel towards a distal end of the mandrel, wherein fluid is configured to flow through a passageway through an inner diameter of the mandrel;

a lower slip positioned between a sealing element and the distal end of the mandrel, the lower slip including a second tapered sidewall that continually increases a second thickness of the lower slip;

a weak point assembly positioned within the mandrel, the weak point assembly including a shear pin and a conduit extending through the weak point assembly; and a rupture disc, the rupture disc being positioned across the conduit and not allowing communication to elements below the rupture disc through the conduit when the rupture disc is secured within the weak point assembly, the rupture disc being directly coupled to the weak point assembly via the shear pin, the shear pin being configured to be sheared based on fluid flowing through the mandrel from the proximal end towards the distal end, and the rupture disc passes through the conduit after the shear pin shearing.

2. The frac plug of claim 1, wherein at least a portion of the second tapered sidewall of the lower slip extends into the recess created by the first tapered sidewall before being deployed, wherein the distal end of the mandrel is positioned downhole from the proximal end of the mandrel.

3. The frac plug of claim 1, further comprising:

an upper slip, wherein the upper slip and lower slip are non-symmetrical elements, and a first maximum thickness of the lower slip is greater than that of a second maximum thickness of the upper slip.

4. The frac plug of claim 1, wherein the sealing element includes a concave outer surface to vary a first cross-sectional area of the sealing element.

5. The frac plug of claim 4, wherein the concave outer surface of the sealing element varies a second cross sectional area between an outer surface of the sealing element and an inner diameter of casing to control a Bernoulli Effect applied to the sealing element, wherein the sealing element is a packer.

6. The frac plug of claim 1, wherein a lower end of the lower slip has a larger thickness than an upper end of the lower slip.

7. The frac plug of claim 1, wherein the weak point assembly is a housing, wherein the shear pin extends through a diameter of the rupture disc to secure the rupture disc within the weak point assembly before the shear pin is sheared, wherein after the shear pin is sheared the rupture disc travels towards the distal end of the mandrel through the housing wherein the rupture disc extends across a central axis of the conduit.

8. The frac plug of claim 7, wherein the housing includes a shear pin hole configured to receive the shear pin, the shear pin hole extending in a direction perpendicular to a central axis of the housing.

9. The frac plug of claim 1, further including:

a one way seal positioned within the weak point assembly, the one way seal forming a seal across an end of the weak point assembly; and an atmospheric chamber positioned within the weak point assembly adjacent to an inner face of the rupture disc and the one way seal, the atmospheric chamber having an atmospheric pressure when the rupture disc is positioned within the weak point assembly and being isolated from the mandrel via the one way seal and the rupture disc.

10. The frac plug of claim 1, wherein the weak point assembly is positioned through the mandrel.

11. A method for a frac plug comprised of:

forming a mandrel with a recess, the recess being a first tapered sidewall that decreases a first thickness of the mandrel from a proximal end of the mandrel towards a distal end of the mandrel, wherein fluid is configured to flow through a passageway through an inner diameter of the mandrel;

positioning a lower slip between a sealing element and the distal end of the mandrel, the lower slip including a second tapered sidewall that continually increases a second thickness of the lower slip;

flowing fluid through the mandrel to shear a shear pin within a housing, the shear pin shearing based on the fluid flowing through the mandrel from the proximal end of the mandrel towards the distal end of the mandrel, wherein the distal end of the mandrel is positioned downhole from the proximal end of the mandrel;

securing a rupture disc across a conduit via a shear pin, the conduit extending through the housing, the rupture disc blocking communications to elements below the rupture disc within the mandrel through the conduit when the rupture disc is secured within the housing;

the rupture disc being directly coupled to the housing via the shear pin;

shearing the shear pin allowing the rupture disc to pass through the conduit;

allowing bi-directional flow of fluid through the conduit within the housing after the rupture disc is removed from the conduit.

12. The method of claim 11, further comprising:

positioning at least a portion of the second tapered sidewall of the lower slip in the recess created by the first tapered sidewall before deploying the lower slip, wherein the distal end of the mandrel is positioned downhole from the proximal end of the mandrel.

13. The method of claim 11, wherein the frac plug includes an upper slip, the upper slip and lower slip are non-symmetrical elements, and a first maximum thickness of the lower slip is greater than that of a second maximum thickness of the upper slip.

14. The method of claim 11, wherein the sealing element includes a concave outer surface to vary a first cross-sectional area of the sealing element.

15. The method of claim 14, further comprising:

controlling a Bernoulli Effect applied to the sealing element via the concave outer surface of the sealing element by varying a second cross sectional area between an outer surface of the sealing element and an inner diameter of casing, wherein the sealing element is a packer.

16. The method of claim 11, wherein a lower end of the lower slip has a larger thickness than an upper end of the lower slip.

17. The method of claim 11, further comprising:

exposing the shear pin to shearing forces via pressure applied on the rupture disc, wherein the shear pin extends through a diameter of the rupture disc to secure the rupture disc within the weak point assembly before the shear pin is sheared, wherein the rupture disc extends across a central axis of the conduit;

moving the rupture disc travels towards the distal end of the mandrel through the housing after shearing the shear pin.

18. The method of claim 17, wherein fluid can flow through the conduit after rupturing the rupture disc.

19. The method of claim 11, a one way seal and an atmospheric chamber are positioned within the housing, the atmospheric chamber being positioned adjacent to an inner face of the rupture disc within the housing, the atmospheric chamber having an atmospheric pressure when the rupture disc is positioned within the housing and being isolated from the mandrel via the one way seal and the rupture disc.

20. The method of claim 11, wherein the housing is positioned through the mandrel.

* * * * *